US006047735A

United States Patent [19]

Casey

[11] Patent Number: 6,047,735

[45] Date of Patent: Apr. 11, 2000

[54] HIGH SPEED SOLENOID VALVE

[76] Inventor: Gary L. Casey, 3981 Corte Cancion, Thousand Oaks, Calif. 91360

[21] Appl. No.: 09/023,991

[22] Filed: Feb. 14, 1998

[51] Int. Cl.[7] ..... F15B 13/04

[52] U.S. Cl. ..... 137/625.38; 251/129.1

[58] Field of Search ..... 251/129.1; 137/625.38, 137/625.35; 123/90.11, 90.12; 335/264, 267, 268

[56] References Cited

U.S. PATENT DOCUMENTS

| | | | |
|---|---|---|---|
| 332,855 | 12/1885 | Worthen | 137/625.38 |
| 1,193,577 | 8/1916 | McGowan | 137/625.38 |
| 3,275,964 | 9/1966 | Kumm | 335/267 |
| 5,249,603 | 10/1993 | Byers, Jr. | 251/129.1 |
| 5,255,641 | 10/1993 | Schechter | 123/90.12 |
| 5,615,708 | 4/1997 | Barron | 137/625.3 |

FOREIGN PATENT DOCUMENTS

| | | | |
|---|---|---|---|
| 0976192 | 11/1982 | U.S.S.R. | 251/129.1 |
| 2076125A | 11/1981 | United Kingdom | 137/625.35 |

*Primary Examiner*—Kevin Shaver
*Assistant Examiner*—John P. Welsh

[57] ABSTRACT

A solenoid-operated fluid switching valve is described with a movable valve member and a stationary member; the movable member containing at least 2 valve elements that seat in the closed position against valve seating elements, the valve and valve seating elements being made from components that can be precisely matched in thickness and interleaved so that all pairs of elements open and close essentially simultaneously. The solenoid portion can consist of at least 2 armature elements connected by a spacer and at least 2 stator elements connected by a spacer, all of which made from magnetically permeable material, and one or more electrical coils located within the envelope; the armature and stator elements interleaved in a way to create at least 2 substantially equal gaps so the armature is urged in one direction when electrical current is applied to the coils.

25 Claims, 5 Drawing Sheets

HIGH SPEED SOLENOID VALVE

BACKGROUND AND SUMMARY OF THE INVENTION

This invention generally relates to high-speed solenoid-operated valves used to control fluid flow and mores specifically to the design of a high-speed solenoid valve used to control intake and exhaust valve movement in an internal combustion engine.

There are many applications for fluid-operated systems that require very fast response and accurate timing. One example of this is intake and exhaust valve actuation in a four-stroke/cycle internal combustion piston engine. Valve actuation has traditionally been accomplished by a cam-operated linkage with a spring used to return each valve to the closed position. Since the timing and duration of the valves are by necessity fixed relative to the crankshaft position, engine operation is compromised. For example, at low speed the intake valve is open too long and some compression pressure is lost by reverse flow out of the intake valve during the compression stroke. By the same token the exhaust valve opens too early, losing some of the effective work that can be accomplished by the combustion gases. At high engine speeds the intake valve closes too early—before the cylinder is completely filled, and the exhaust valve opens too late, leaving residual pressure in the cylinder that has to pumped out during the exhaust stroke. One solution to this problem is to operate the valves with hydraulic power and switch the hydraulic pressure with solenoid valves in response to signals from an engine control computer. However, the hydraulic system has till now suffered from a number of deficiencies. Known hydraulic valves are bulky in size and are limited in flow rate and responsiveness to electrical signals. These limitations reduce the rate at which the engine valves can be opened or closed. Also, solenoid valves with the required force are very heavy and incorporate high-mass moving parts. They also have a very high inductance, requiring high supply voltages to operate at the required speed.

There exists a need for a high speed solenoid valve that is capable of valving high pressure fluid on or off at a high speed without the limitations described above. Such a device can be used, for example, to direct oil to servos used to open and close engine inlet and exhaust valves. The object of this invention is to provide a fast-response, compact valve and low cost valve that is solenoid actuated.

Accordingly, the invention comprises:

A fluid switching valve with a valve member and a stationary member; the valve member containing at least 2 movable valve elements that seat in a first closed position against mating valve seating elements. A cavity formed between the elements is alternatively connected to or isolated from a second cavity by the movement of the valve elements. The valve elements and valve seating elements are made from components that can be precisely matched in thickness and interleaved so that all pairs of elements open and close simultaneously with motion of the valve elements.

DETAILED DESCRIPTION OF THE DRAWINGS

Figure 1:
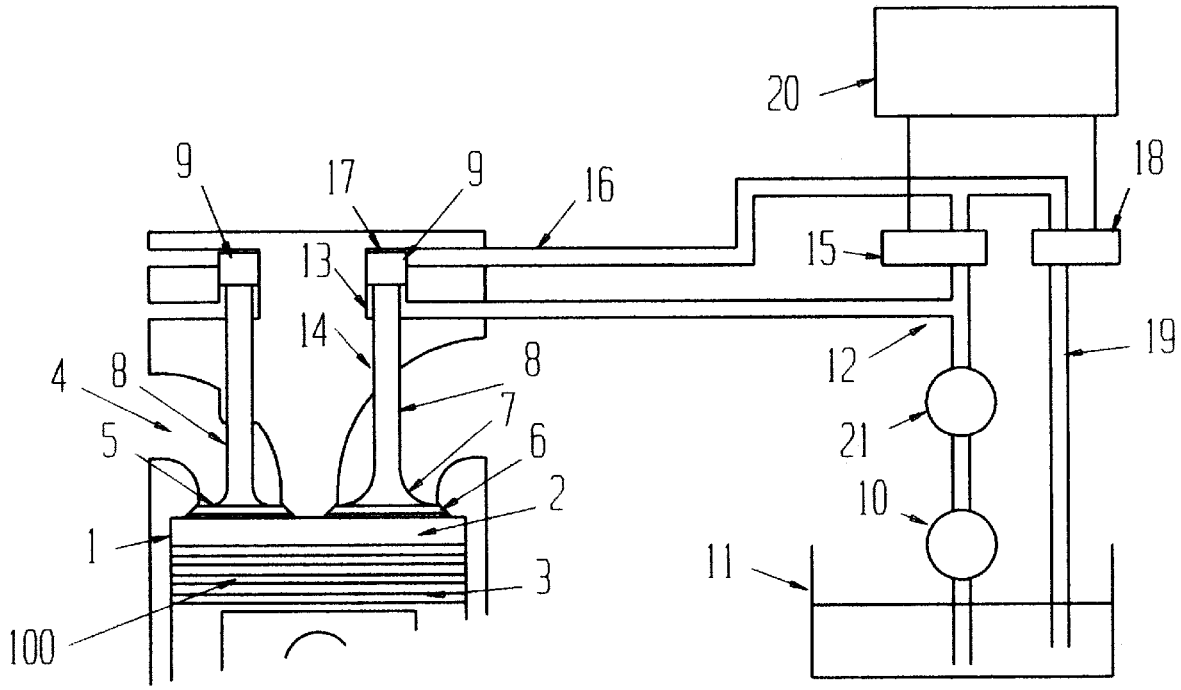
FIG. 1 diagrammatically shows the operation of the intake and exhaust valves of an engine utilizing one implementation of the invention.

Although there are any number of possible applications, one such application of the present invention is shown in FIG. 1 in conjunction with the valve mechanism of an internal combustion engine. Since the operation of most of either a spark ignition or diesel engine is commonly known, only the pertinent parts are shown and discussed. FIG. 1 illustrates and engine 100 having a cylinder 1 which contains a piston 2 and encloses a combustion chamber 3. Air with or without mixed fuel enters the combustion chamber 3 from the intake port 4 when the intake valve 5 moves downward, opening a passage between the intake port and the combustion chamber. After the combustion and power stroke occurs, the exhaust valve 6 opens, allowing the spent mixture to be pumped out into the exhaust port 7.

The valves 5 and 7 incorporate a stem 8 and an enlarged portion, or piston 9. Since both valves operate in an identical manner, only one valve actuation system is shown in detail. A hydraulic pump 10, driven by the engine or some other means, withdraws oil or other fluid from a reservoir 11 and discharges it to a pressure regulator 20 which could regulate the pressure to either a constant or variable value. The pressure-regulated oil travels through a manifold 12 to one of two destinations, the valve 15 and chamber 13. The chamber 13 at the underside of the piston 9 is supplied with oil under pressure, which, because of the difference in area of the valve stem 14 and the piston 9, forces the valve closed against the valve seat 6. This is the closed position of the valve. When the appropriate portion of the engine cycle approaches the solenoid valve 15, which is normally closed, is opened by an electrical signal from the Electronic Control Unit (ECU) 20 Through the wire 60, allowing fluid under pressure to pass through passage 16 into chamber 17 above the piston 9. Because this area is larger than the area below the piston, the net effect is to force the valve 5 open until the lower portion of the piston 9 contacts the lower portion of the cavity 13. The valve 5 remains open until the solenoid 15 is closed by removing the electrical signal and the similar solenoid valve 18 is opened, also by an electrical signal from the ECU 20, to vent the pressure back to the reservoir 11 through a passage 19.

The solenoid valves 15 and 18 are controlled by the Electronic Control Unit 20, of known construction, which computes the most desirable opening and closing times for each valve and creates and electrical signal capable of operating the valves. The same system can be duplicated for each intake and exhaust valve for each cylinder except that the ECU 20 would typically incorporate multiple channels capable of operating the required number of valves. For this type of system to be practical, the solenoid valves must have very high flow capacity and very rapid response capability compared to currently available solenoid valves. At the same time, the solenoid valves must be of very low cost in order to make the system economically viable.

Figure 2:
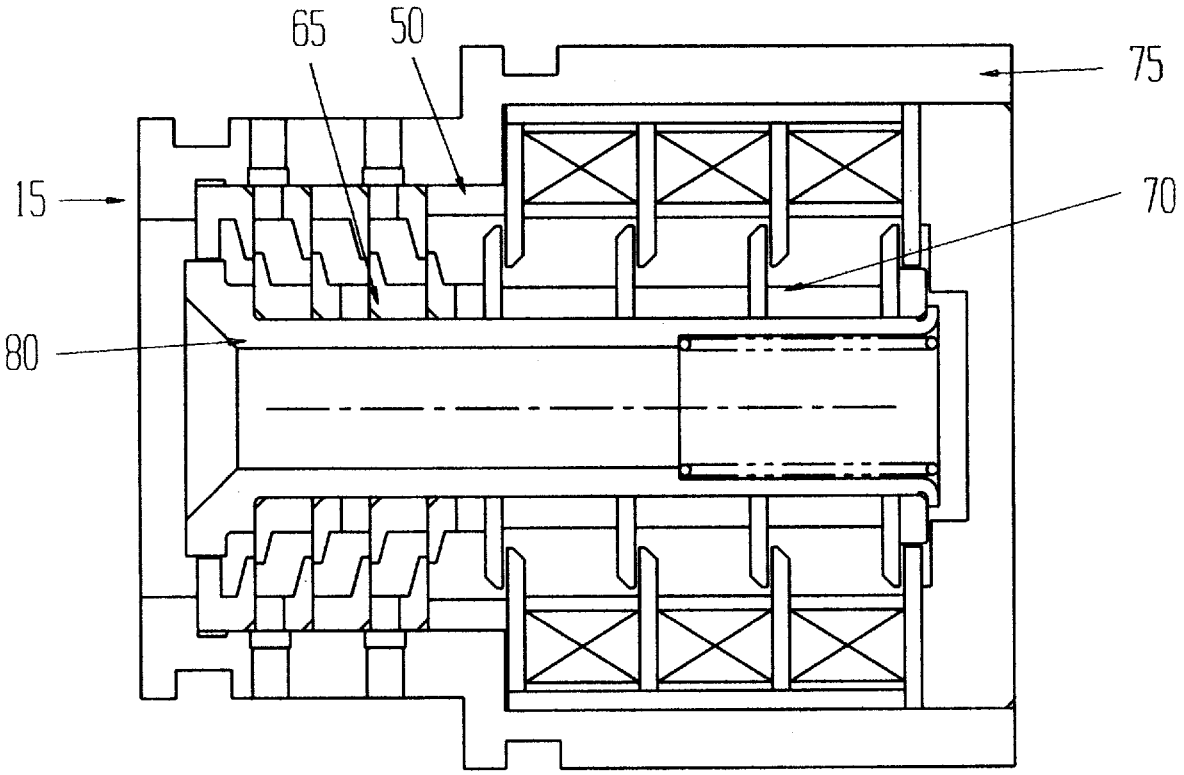
FIG. 2 shows a cross-sectional view of the proposed valve and solenoid through its centerline, the valve being circular about the centerline.
Figure 3:
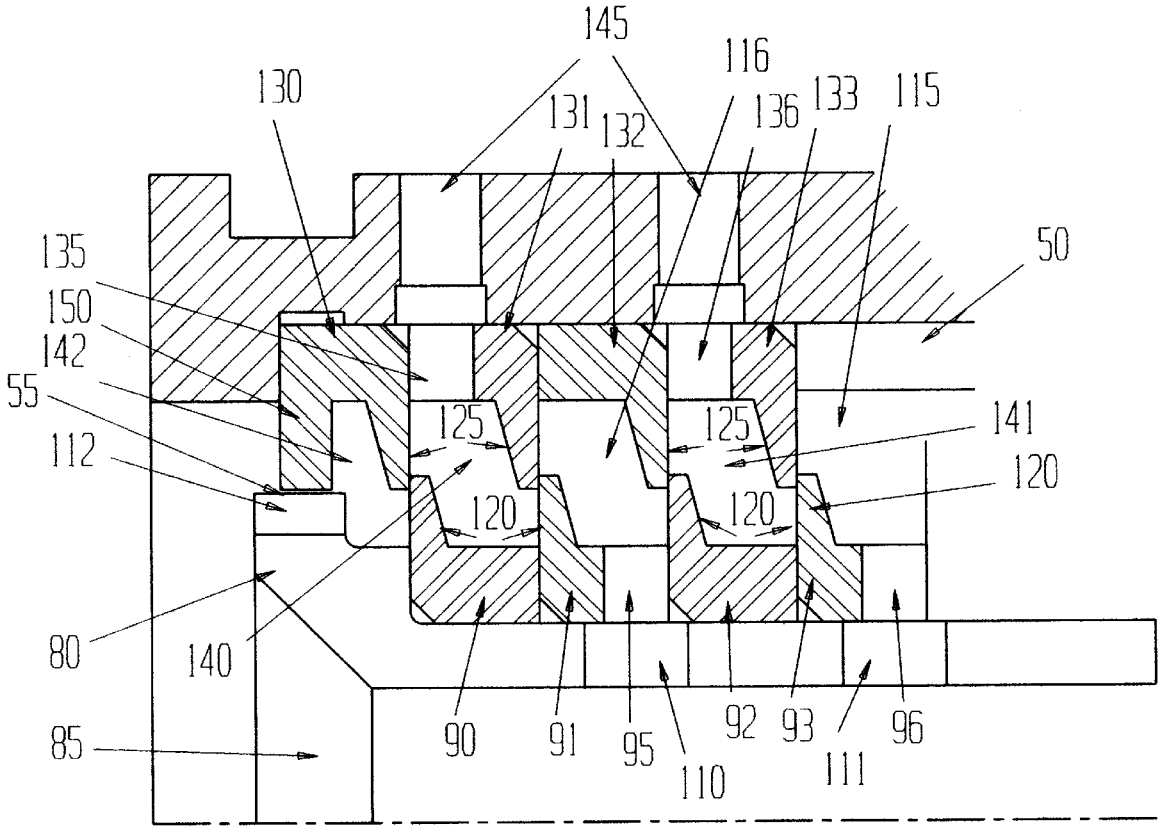
FIG. 3 shows an expanded view of the valve limited to one side of the centerline for clarity.

FIG. 2 shows a cross-section of the solenoid valve assembly 15, which is symmetrical about the centerline and nominally circular in section. The solenoid valve assembly 18 is of the same design and construction as the valve assembly 15. The valve portion 65 and the solenoid assembly 70 are contained in the same housing 75 and the moving parts are connected by a common armature 80. Referring to FIG. 3, an enlarged half section of the valve 65 only, the preferred embodiment of the solenoid-operated valve 65 consists of a housing 75 and an armature 80. High pressure fluid, supplied typically by a pump 10, enters at the inlet port 85 and exits the exhaust ports 145. The valve 65 contains movable valve elements 90, 91, 92, and 93. Valve elements 91 and 93 incorporate slots 95 and 96 that allow fluid to flow from the inlet port 85 through passages 110 and 111 in the valve stem 80 into valve cavities 115 and 116. The valve members contain extensions 120 that contact similar internal extensions 125 on the valve seat elements 130, 131, 132, 133. Valve seat elements 131 and 133 contain slots 135 and 136 that allow fluid to flow from cavities 140 and 141 out through the exhaust ports 145. There is also one or more notches 112 in the valve stem 80 that allow fluid to flow from the inlet port 85 to the cavity 142. The valve members are normally held against the valve seat members by the spring 27 shown in FIG. 4. When the valve is energized the valve stem 80 moves to the right enough to separate the valve elements 90, 91, 92, and 93 from the valve seat elements 90, 91, 92, and 93 from valve seat elements 130, 131, 132, and 133. This motion allows fluid to flow from cavity 142 to cavity 140, from cavity 116 to cavities 140 and 141 and from cavity 115 to cavity 141. These represent 4 parallel paths for fluid flow. The travel of the valve is limited by the contact of spacer 46 with a portion of the end plate 48, both shown on FIG. 4.

Figure 4:
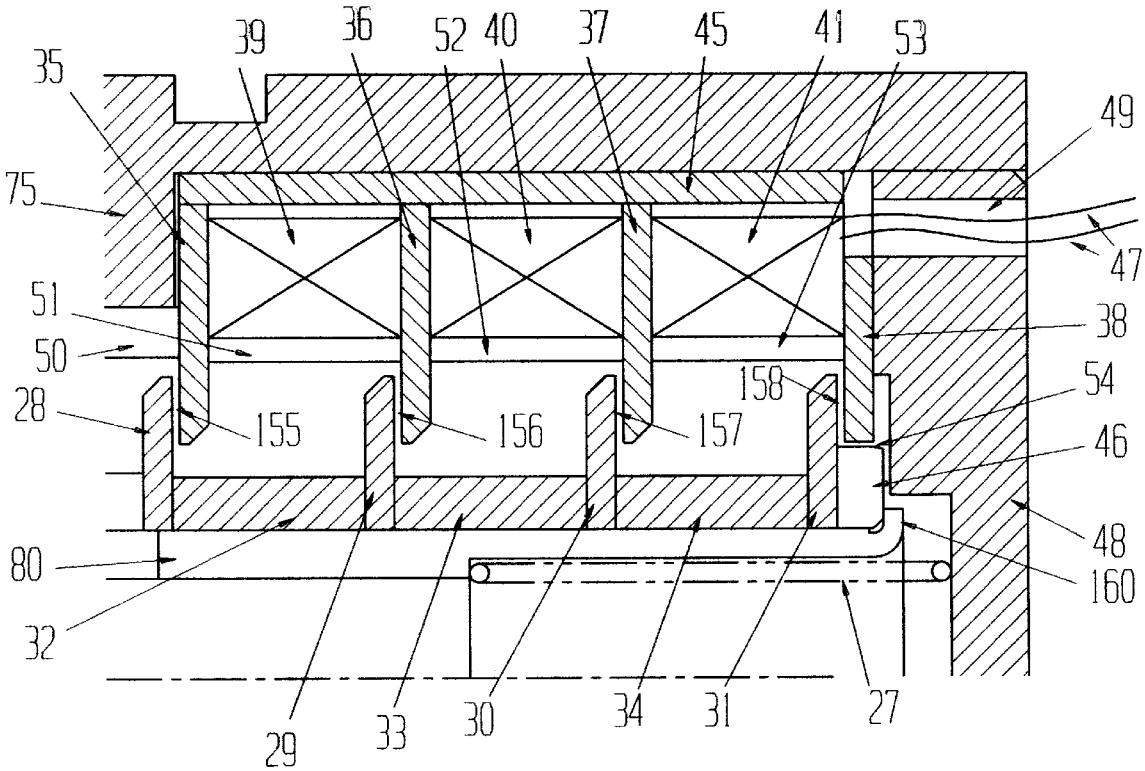
FIG. 4 shows an expanded view of the solenoid limited to one side of the centerline for clarity.

The solenoid portion 70 of the valve assembly 15 shown in FIG. 4 is constructed in a geometrically similar fashion as the fluid portion of the valve. Armature members 28, 29, 30, and 31 are attached to the valve stem 80 and are made from magnetically permeable material such as soft steel or silicon-filled steel. These are separated but magnetically connected by the spacers 32, 33, and 34, also fabricated from magnetically permeable material. The fixed portion of the solenoid 70 consists of the pole pieces 35, 36, 37, and 38 and the outer sleeve 45, all made of magnetically permeable material. Coils of wire 39, 40, and 41 are wound on the inner sleeves 42, 43, and 44 that are made of non-magnetic material with high electrical resistance, such as brass or stainless steel. The coils 39, 40 and 41 are wound in opposite directions to each adjacent coil, for example, if coil 39 were to be wound counter-clockwise, 40 would be wound clockwise, and 41 wound counter-clockwise. The armature 80 is supported by spacer 46 which rides inside pole piece 38 and by the opposite end of the armature 80 which rides on the inside of valve seat 130. The coils 39, 40 and 41 are connected to a power source 20 by leads 47 that exit the end plate 48 through the passage 49. The coils can be wound directly upon the metal spacers 51, 52 and 53 or can be wound on separate bobbins prior to installation. The force required to move the armature 80 against the force of spring 27 is produced by combined attraction of the armature 28 and pole piece 35, armature 29 to pole piece 36, armature 30 to pole piece 37 and armature 31 to pole piece 38 across the gaps 155, 156, 157 and 158.

A principle characteristic of the valve of the present invention is that all components are very simple in shape and can be made by normal manufacturing methods. Many of the components of the valve have a common shape so that they can be made simultaneously with a single process. The valve of the present invention has been designed to operate with easily maintainable manufacturing tolerances. All valve members are identical in shape except that 91 and 93 have notches 95 and 96 cut across one end. Three of the four valve seats 131, 132, and 133 are identical except for the notches 135 and 136 and the last valve seat 130 is identical to the others except for the extension 150 which acts as a guide for the armature 80. While it is preferred that all the valve seats 130, 131, 132 and 133 and valve members 90, 91, 92 and 93 are of a given axial length this length need not be exact as long as all members are substantially equal in axial length. This can be achieved by grinding all the parts to length as a matched set, which is a very simple process on a conventional surface grinder. Matching axial lengths insures that all valves will close at exactly the same time, producing a leak-tight seal between each pair of valves and valve seats. Simultaneous finishing to a high degree of flatness also allows the valve to be assembled without elastomeric seals if desired, the sealing between valve members 90, 91, 92 and 93 and valve seats 130, 131, 132, and 133 being accomplished solely by metal-to-metal contact. Spacer 50 shown in FIG. 2 is of a length that, combined with the length of valve member 93 and the thickness of armature 28, will produce the desired air gap between the armature and pole piece. In the solenoid portion, spacers 32, 33, 34, 51, 52 and 53 are all ground to a length as a matched set as are the magnetic members 28, 29, 30, 31, 35, 36, 37, and 38, guaranteeing that the air gaps of all armature members are essentially identical.

Figure 5:
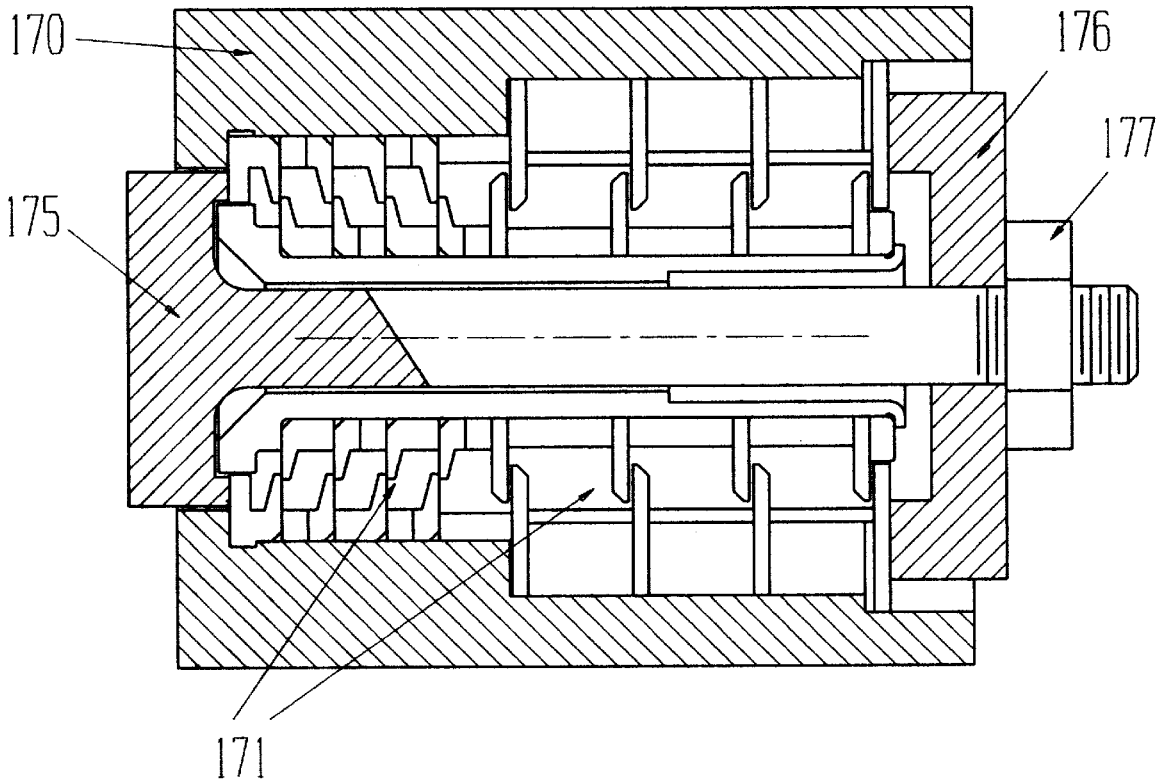
FIG. 5 shows a cross-sectional view of the assembly fixture.

Assembly of the valve 15 is quite simple in spite of the large number of parts. The valve members and other components are loaded in turn on to the armature 80 with the outer members loosely interspersed as appropriate. All valve members are then permanently retained by riveting the end of the armature 80 or by other suitable means as shown generally by numeral #160 in FIG. 4. The complete assembly is then inserted into an assembly fixture 170 shown in FIG. 5 that has the same internal dimensions as the housing 75 of the actual valve 15, aligning all components 171. The clamp 175 and retainer 176 is then installed and tightly clamped by a nut 177 or other suitable means. The valve components 171 are then held in alignment while the fixture 170 is remove. The coils 39, 40 and 41 can then be wound directly on the spacers 51, 52 and 53 unless the coils were previously wound on bobbins in which case they would be part of the assembly. preferably, but not necessarily, the coils 39, 40 and 41 can then potted with a material such as epoxy or some other suitable adhesive. The complete assembly can then be loaded into the actual housing 75, the clamp 175, 176 removed and permanently retained with the cover 48 which is in turn retained by bolts, welding or other known permanent method of attachment.

In operation, voltage is applied to the coils 39, 40 and 41, which can be wired either in series or parallel, to actuate the valve. If current passed through coil 39 in a direction to produce a north pole in pole piece 35 there would be a south pole in pole piece 36. Coil 40, because it is wound in the opposite direction as coil 39, would produce a south pole in 36 and a north pole in 37. Coil 41, because it is wound in the opposite direction as coil 40, would produce a north pole in 37 and a north pole in 38. In this way, the magnetic fields produced by the coils reinforce each other. The magnetic lines of flux travel from pole piece 35 through the sleeve 45, into the pole piece 36, across gap 156 to armature member 29, through the spacer 32, into the pole piece 28 and back across gap 155 to 35. both of the air gaps contribute to the force that moves the armature. In a similar fashion flux travels through the other magnetic circuits and contributes to the total force. With voltage applied to the coils 39, 40 and 41 the current will rise to a level sufficient to create a magnetic force to overcome the spring force 27 so that the valve member 80 moves to the open position.

In the preferred embodiment the valve consists of a multiplicity of valve members that all contribute to the flow. For example, fluid can travel from the inlet 85 through ports 110 and 95 into cavity 116. From there it can flow both to cavity 140 and to cavity 141 and out through passages 135, 136 and 145.

The valve members 90, 91, 92, 93, 130, 131, 132 and 133 are similar to other known poppet valves—This type of valve has the advantage of having large flow openings at small armature travel. However, known poppet valves exhibit large pressure force unbalance, requiring large forces to open the valves against pressure. An example is the engine intake and exhaust valves 8 shown in FIG. 1. The total area of the valve head 5 and 7 is acted on by the pressure in the combustion chamber and the actuator has to overcome this force to open the valve. In the present invention, the forces are balanced by the symmetry of the valve design. For example, the pressure in cavity 116 imparts a closing force on valve member 91, but it exerts a substantially equal opening force on valve member 92. This same balance exists on valve members 90 and 93. Another advantage of poppet valves is the low leakage produced by positive metal-to-metal contact of the valve and the valve seat, which also exists in this design. Exact pressure balancing requires that the mating surfaces of all valve be identical. This is easily obtainable because the valve diameters are preferably commonly machined.

Because of the multiple coil design, very large active gap areas are practical, which is the sum of the area of the gaps 155, 156, 157 and 158, which increases the magnetic force at any level of electric current compared to conventional designs. This large effective area also reduces the amount of flux that has to be carried by the magnetically permeable material in the magnetic path, reducing the weight of the armature 80 and further improving the performance of the valve. A further advantage can be identified by analyzing the fluid flow within the valve during the opening and closing processes. Known poppet valves displace a considerable volume of fluid because of the movement of the poppet. However, by pairing multiple valves, the fluid that would have been displaced by one valve element is absorbed by the movement of the adjacent valve element. For example, when the armature 80 moves to the right in FIG. 3 the valve element 92 would increase the fluid volume in chamber 116 except that valve element 91 simultaneously reduces the volume by the same amount, completely negating the effect. Therefore, the flow losses that would normally impede the rapid movement of the valve are substantially eliminated. This is true of both the valve portion 65 and the solenoid portion 70 of the present invention.

Since the alignment of the valve is not as critical as in a conventional spool or poppet valve, guidance can be accomplished by relatively small area bearings 54 and 55. These small bearing act to further reduce the viscous losses and speed up the valve travel compared to known valves.

A further advantage is that the poppet valve members produce a positive, leak-tight seal and yet are virtually pressure-balanced, allowing the use of a low-force return spring 27 and a small solenoid. The multiple flow paths increase the flow of the valve without increasing the travel, further reducing the size of the solenoid.

Many changes and modifications in the above described embodiment of the invention can be realized without departing from the scope thereof. Accordingly, that scope is intended to be limited only by the scope of the appended claims.

I claim:

1. A fluid switching valve with a valve member and a stationary member; the valve member comprising at least two (2) movable valve elements that seat in a first closed position against mating valve seating elements, a first cavity formed between the elements being alternatively connected to or isolated from a second cavity by the movement of the valve elements, the valve elements and valve seating elements being made from components that are matched in thickness and interleaved so that all pairs of elements open and close simultaneously by a common motion of the valve elements.

2. A fluid switching valve with a valve member and a stationary member; the valve member comprising at least two (2) movable valve elements that seat in a first closed position against mating valve seating elements, a first cavity formed between the elements being alternatively connected to or isolated from a second cavity by the movement of the valve elements, the valve elements and valve seating elements being made from components that are matched in thickness and interleaved so that all pairs of elements open and close simultaneously by a common motion of the valve elements; including a solenoid consisting of at least two (2) movable armature elements connected by a spacer made from magnetically permeable material and at least two (2) stator elements connected by another spacer made from non-magnetic material, and an electrical coil located within an envelope formed within the spacer and stator elements; the armature and stator elements interleaved to create at least two (2) substantially equal air gaps, wherein the armature is urged in one direction when electrical current is applied to the coil.

3. The device as defined in claim 2 wherein the movable elements are urged in a first direction by a resilient member.

4. The device as defined in claim 3 wherein the movable elements are urged toward the closed position by the resilient member.

5. The device as defined in claim 3 wherein the movable elements are urged in a second direction by an electromagnetic coil and armature.

6. The device as defined in claim 2 wherein the movable valve elements comprise four (4) elements and the valve seating elements comprise four (4) elements, all being the same thickness.

7. The device as defined in claim 6 wherein a first fluid source is introduced between alternate pairs of one of the valve or valve seating elements and a second fluid source is introduced between remaining elements.

8. The device as defined in claim 6 where the valve elements are disc-shaped with a cylindrical extension such that exposed disk surfaces are first precision ground and lapped to a flat smooth surface to a 16 micro-inch finish or better, followed by machining or grinding the opposite surface simultaneously to a thickness whereby all valve elements are within 0.0002 inches of the same thickness.

9. The device as defined in claim 2 wherein the valve and valve seating elements are of substantial equal thickness that are finished in the same manufacturing operation.

10. A fluid switching valve with a valve member and a stationary member; the valve member comprising at least two (2) movable valve elements that seat in a first closed position against mating valve seating elements, a first cavity formed between the elements being alternatively connected to or isolated from a second cavity by the movement of the valve elements, the valve elements and valve seating elements being made from components that are matched in thickness and interleaved so that all pairs of elements open and close simultaneously by a common motion of the valve elements; wherein the movable valve elements and valve seating elements are substantially disc-shaped with either the valve member or the stationary member comprising a larger outer diameter and the other member comprising an inner diameter with a sealing surface comprising flat surfaces on the inner portion of the outer member and a flat surface of the outer portion of the inner member, the surfaces being substantially perpendicular to a direction of motion of the valve member.

11. The valve as defined in claim 10, including a solenoid consisting of at least two (2) movable armature elements connected by a spacer and at least two (2) stator elements connected by another spacer, all of which are made from magnetically permeable material, and an electrical coil located within an envelope formed within the spacer and stator elements; the armature and stator elements interleaved to create at least two (2) substantially equal air gaps, wherein the armature is urged in one direction when electrical current is applied to the coil.

12. The device as defined in claim 10 wherein the valve and valve seating elements are of substantial equal thickness that are finished in the same manufacturing operation.

13. The device as defined in claim 10 wherein the movable valve elements comprise four (4) elements and the valve seating elements comprise four (4) elements, all being the same thickness.

14. The device as defined in claim 13 wherein a first fluid source is introduced between alternate pairs of one of the valve or valve seating elements and a second fluid source is introduced between remaining elements.

15. The device as defined in claim 13 where the valve elements are disc-shaped with a cylindrical extension such that exposed disk surfaces are first precision ground and lapped to a flat smooth surface to a 16 micro-inch finish or better, followed by machining or grinding the opposite surface simultaneously to a thickness whereby all valve elements are within 0.0002 inches of the same thickness.

16. The device as defined in claim 10 wherein the movable elements are urged in a first direction by a resilient member.

17. The device as defined in claim 16 wherein the movable elements are urged toward the closed position by the resilient member.

18. The device as defined in claim 16 wherein the movable elements are urged in a second direction by an electromagnetic coil and armature.

19. The device as defined in claim 1 wherein the valve and valve seating elements are of substantial equal thickness that are finished in the same manufacturing operation.

20. The device as defined in claim 1 wherein the movable valve elements comprise four (4) elements and the valve seating elements comprise four (4) elements, all being the same thickness.

21. The device as defined in claim 20 wherein a first fluid source is introduced between alternate pairs of one of the valve or valve seating elements and a second fluid source is introduced between remaining elements.

22. The device as defined in claim 20 where the valve elements are disc-shaped with a cylindrical extension such that exposed disk surfaces are first precision ground and lapped to a flat smooth surface to a 16 micro-inch finish or better, followed by machining or grinding the opposite surface simultaneously to a thickness whereby all valve elements are within 0.0002 inches of the same thickness.

23. The device as defined in claim 1 wherein the movable elements are urged in a first direction by a resilient member.

24. The device as defined in claim 23 where the movable elements are urged toward the closed position by the resilient member.

25. The device as defined in claim 23 where the movable elements are urged in a second direction by an electromagnetic coil and armature.

* * * * *